US005440444A

United States Patent [19]

Adams

[11] Patent Number: 5,440,444

[45] Date of Patent: Aug. 8, 1995

[54] MULTI-PATH STATIC CONTROL GARMENT

[76] Inventor: Kay L. Adams, P.O. Box 188036, Carlsbad, Calif. 92009

[21] Appl. No.: 191,625

[22] Filed: Feb. 4, 1994

[51] Int. Cl.[6] ..... H05F 3/02

[52] U.S. Cl. ..... 361/220; 361/212

[58] Field of Search ..... 361/212, 220, 223, 224; 2/1, 51, 901, 902; 57/901

[56] References Cited

U.S. PATENT DOCUMENTS

| | | | |
|---|---|---|---|
| 318,172 | 5/1885 | Delany | 361/220 X |
| 1,940,491 | 12/1933 | Freitag | 174/558 |
| 3,011,172 | 12/1961 | Tames | 2/51 |
| 3,349,285 | 10/1967 | Belkin | 361/220 |
| 3,381,174 | 4/1968 | Geraldi | 361/223 |
| 3,596,134 | 7/1971 | Burke | 361/220 |
| 3,699,590 | 10/1972 | Webber et al. | 361/220 |
| 4,321,925 | 3/1982 | Hoborn et al. | 128/303 |
| 4,590,623 | 5/1986 | Kitchman | 57/901 X |
| 4,596,053 | 6/1986 | Cohen et al. | 2/1 |
| 4,639,825 | 1/1987 | Breidegam | 361/212 |
| 4,676,561 | 6/1987 | Barrett, II | 439/37 |
| 4,680,668 | 7/1987 | Belkin | 361/220 |
| 4,868,710 | 9/1989 | Powell | 361/212 |

*Primary Examiner*—Todd Deboer
*Assistant Examiner*—Fritz M. Fleming
*Attorney, Agent, or Firm*—Richard L. Gausewitz

[57] ABSTRACT

A dual path static control garment is formed of a garment material having a continuous grid of conductive fibers throughout the body section and sleeves. One elastic wrist hugging cuff is formed of an electrically conductive material and thereby connects one wrist of the wearer, through the garment itself, to a first grounding terminal secured to a body section of the garment. A second and independent grounding path is provided from the second cuff to a second grounding terminal on the body section. The second path is provided by a cuff assembly having an inner conductive wrist hugging cuff and an outer nonconductive cuff connected to the garment sleeve. A conductive ribbon encased in an insulating sheath electrically interconnects the inner conductive cuff to the second grounding terminal and is insulated from the garment and its sleeves to provide the second independent grounding path.

11 Claims, 3 Drawing Sheets

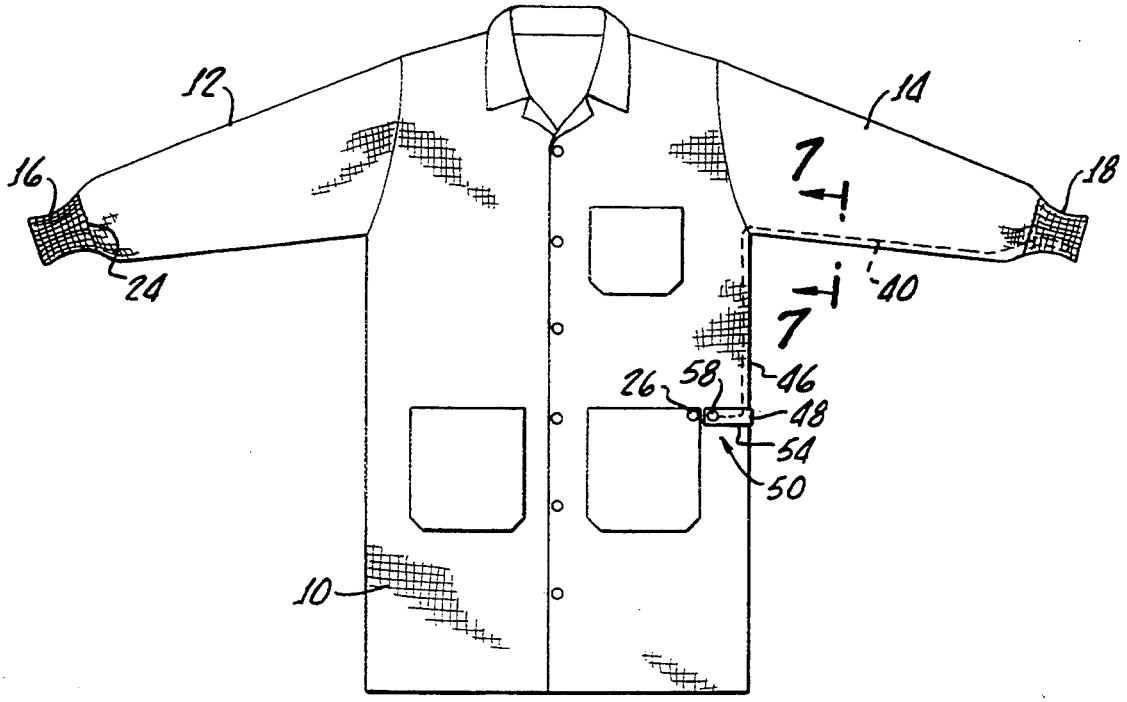
FIG. 1.
FIG. 2.
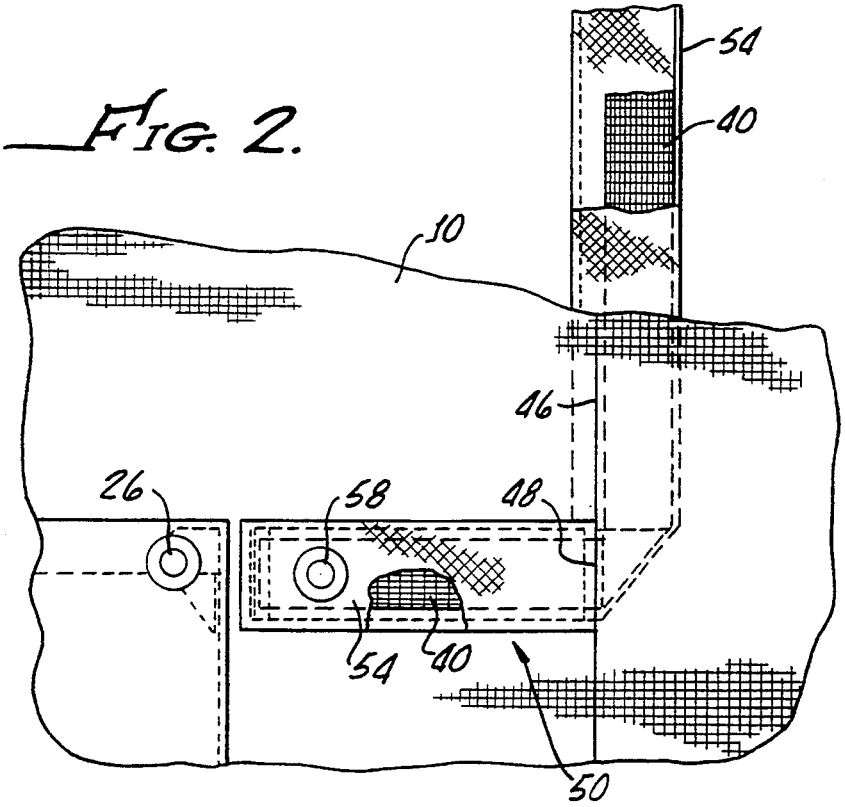

MULTI-PATH STATIC CONTROL GARMENT

BACKGROUND OF THE INVENTION

1. Field of the Invention

The present invention relates to static control garments, and more particularly concerns a garment having multiple independent grounding paths from different points of the body to separate grounding terminals and to monitoring devices.

2. Description of Related Art

Electronic components are extremely sensitive to external electrical potentials and may often be subject to static electricity, particularly during manufacture and assembly. Workers involved in manufacture and assembly of electronic components often generate large amounts of static electricity, amounts that are capable of doing serious damage to or effectively destroying the electronic components. Such damage may not be noticed until further steps in the assembly have been completed, until all assembly has been completed, or at times until the components are actually installed in an operating environment. Various articles have been employed to avoid the detrimental and potentially disastrous effects of static electricity generated by manufacturing and assembly workers. Some of the traditional articles for eliminating static electricity have included grounded wrist straps, grounded smocks, and grounded heel connections. Some anti-static devices, to ensure operability of the grounding of the worker, have employed redundant grounding, utilizing a single wrist strap or band having two separate sections, each of which, on the same wrist band, separately contacts the wearer's wrist and is separately connected to a grounding circuit. The wrist band is an additional item that must be connected and applied to the worker each time that a work period commences. The discomfort and inconvenience of the wrist band and attached grounding cord may tend to encourage some workers to omit the device entirely, thus increasing the danger of static electricity damage to the components being worked on.

Accordingly, it is an object of the present invention to provide a static control garment that avoids or minimizes the above-mentioned, and other problems.

SUMMARY OF THE INVENTION

In carrying out principles of the present invention in accordance with a preferred embodiment thereof, a multi-path static control garment comprises an electrically conductive body section and first and second electrically conductive sleeve sections. First and second electrically conductive body contact means on the respective first and second sleeve sections are each adapted to contact the arms of the wearer of the garment. The body contact means on the first sleeve section is connected through the garment to a first grounding terminal on the garment body section. A second and independent grounding path is provided from the second electrically conductive body contact means through a connecting means that is insulated from the second sleeve section, and from the body section, and is electrically connected to a second grounding terminal on the body section. Such second terminal is insulated from the garment.

Thus, the garment has first and second sleeve cuffs that are adapted to electrically contact the wrists of the wearer of the garment, and comprises two separate independent and mutually isolated grounding paths from the two cuffs to first and second mutually insulated grounding terminals on the body section, thereby achieving a greatly improved manner of redundant grounding of the wearer.

BRIEF DESCRIPTION OF THE DRAWINGS

FIG. 1 is a front illustration of a garment embodying principles of the present invention.

FIG. 2 is an enlarged fragmentary view showing the grounding terminals.

DETAILED DESCRIPTION OF THE PREFERRED EMBODIMENT

Figure 3:
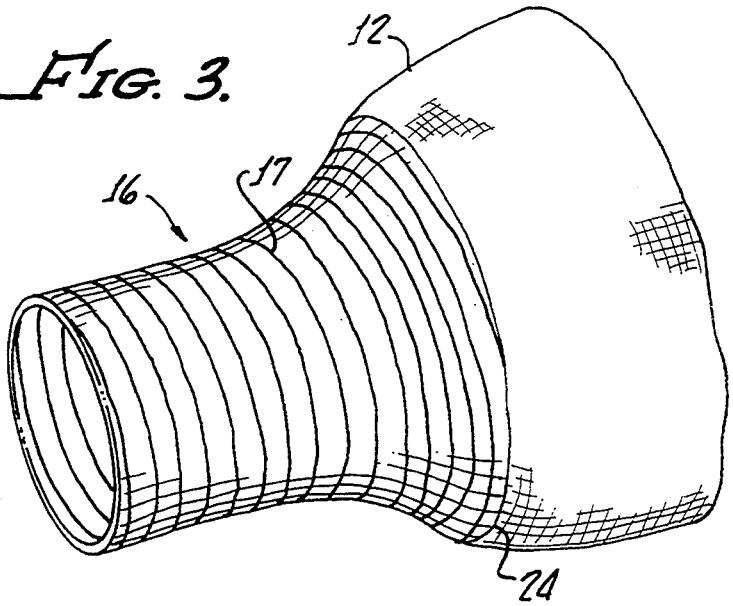
FIG. 3 is a pictorial view showing the outer portion of one of the electrically conductive sleeves.

The garment illustrated in FIG. 1 is in the form of a smock or shop jacket of generally knee or mid-thigh length, having a metal snap front that can be opened and closed. This particular style of garment is employed solely for purposes of illustration, since, as will be readily understood, the shape and style of the garment can vary without departing from principles of the present invention.

The garment includes a body section 10 and sleeve sections 12,14, that respectively terminate in cuffs 16,18. All of the garment, except only the cuffs, is made of a knit fabric having knit therein an electrically conductive grid. In a presently preferred example, the main body of the garment is knit of 89% polyester and 11% carbon-suffused monofilament nylon knitted into a conductive grid pattern therein. Such grid is formed of a monofilament nylon that is suffused with carbon to provide electrically conductive carbon fibers throughout the entire body section and sleeve sections of the garment. The knit carbon suffused grid has squares of approximately $\frac{1}{8}$ to $\frac{1}{4}$ inch. The grid defines a Faraday cage shield to shield components being worked on from any radiation or static electricity of the wearer's clothing, since the illustrated garment is generally worn over the wearer's clothing.

One of the cuffs, such as cuff 16 for example, is made of a wrist hugging tubular knit fabric that will fit tightly around and against the skin of the wrist of the wearer. The cuff is made with an electrically conductive fiber 17 knit therein so that the cuff is basically electrically conductive. In a particular example, such fiber is a continuous silver coated thread 17 knit in a spiral through and around the cuff, having tighter and tighter turns as the spiral approaches more closely to the seam 24 between the cuff and the sleeve. The cuff is sewn to the end of the sleeve 12 along the seam 24, this being a sufficiently tight seam to press the conductive fiber 17 of the cuff against the conductive fibers of the carbon grid of the sleeve, thereby providing electrical contact between the cuff and the sleeve and, accordingly, between the cuff and the remainder of the conductive body and sleeve sections.

First grounding means in the form of a metallic grounding terminal 26 (see FIG. 2) is mounted to the body section 10 of the garment, at an area adjacent one side of the garment in the vicinity of the wearer's hip. The grounding terminal is in the form of the male portion of a snap fitting. The female portion of such fitting is connected to a grounding cable which, in turn, is connected to a suitable grounded circuit. Thus the cuff 16, conductive sleeve 12 and the conductive body section 10, together with grounding terminal 26, provide a first grounding path that grounds the wearer's body.

Figure 4:
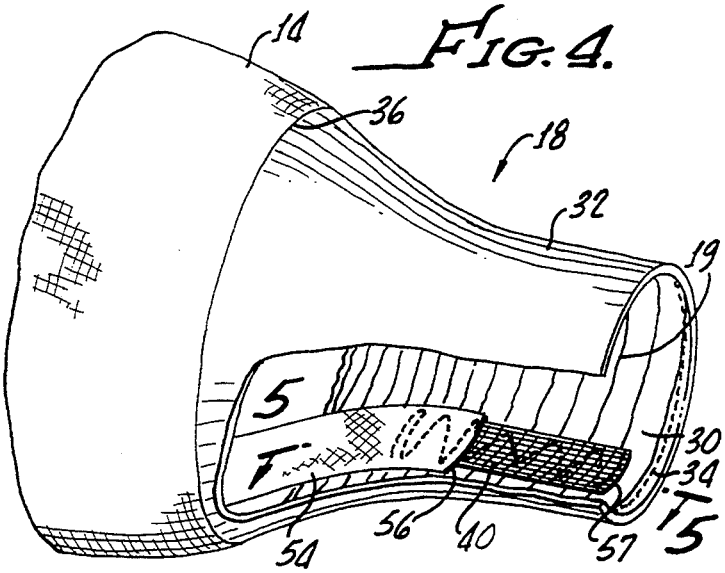
FIG. 4 is a pictorial illustration of the outer end of a second one of the electrically conductive sleeves, together with portions of a conductive connecting ribbon.

A second, independent, and redundant grounding path is provided from the second cuff 18 (FIG. 4). This cuff (cuff assembly) is formed of an inner wrist hugging cuff 30 which is made of the same electrically conductive material as is cuff 16, and, like cuff 16, is made in a tubular knitted and stretchable form to fit tightly around and in direct contact with the skin of the wrist of the wearer. Cuff 18, like cuff 16, has a spiral wound conductive fiber 19 that contacts the skin of the wrist of the wearer but that does not extend into the seam between the inner cuff and the sleeve.

Figure 5:
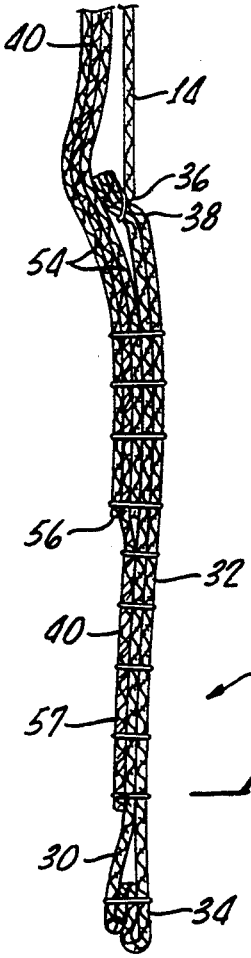
FIG. 5 is an enlarged fragmentary detail section on line 5—5 of FIG. 4, showing the construction of the conductive sleeve of FIG. 4.

Inner cuff 30 is directly secured by nonconductive threads to an outer cuff 32, which also is of a knitted, stretchable tubular construction but which is made entirely of a nonconductive material, such as polyester or the like. The inner and outer cuffs 30,32 are sewn together along an outer seam 34 and are sewn to each other—and to a lowermost end 36 of the second sleeve 14—along an inner seam 38. The threads that form seam 38 (and 34) are of a nonconductive material. Moreover, the construction is such, as illustrated in FIG. 5, that the nonconductive outer cuff 32 is interposed between the conductive inner cuff 30 and the conductive sleeve 14. Accordingly, there is no electrical contact between the inner cuff 30 and the sleeve 14. The two are electrically insulated from one another.

To provide the second and independent grounding path from the second cuff 18, namely from inner cuff 30 thereof, an electrically conductive connecting member in the form of an electrically conductive ribbon 40 is provided. It has a first end pressed directly into contact with the inner surface of inner cuff 30 and sewn thereto by nonconductive thread. The ribbon 40 extends upwardly along the cuff and along the inner or lower side of sleeve 14 (see FIG. 1), around the armpit and down along the inside of a side 46 of the body section 10 to a point 48. At point 48, the body section 10 is formed with a hole to allow the end of the conductor 40 to pass to the outside of the garment for a short distance, as indicated at 50 in FIG. 2.

In order to insulate the conductive ribbon 40 from the electrically conductive sleeve section 14 and from the electrically conductive body section 10, conductor 40 is wrapped in an insulating sheath 54 formed by a section of cloth binding material made of nonconductive cotton or the like. Insulating sheath 54 has a first end 56 that terminates short of the outermost end portion 57 of the conductor 40 so that at this outermost end portion 57 the conductor is in direct electrical contact with the inner side of inner cuff 30.

The insulating sheath 54 covers the remainder of the entire length of the conductor ribbon 40, extending with the conductor upwardly along the inner (lower) side of sleeve 14, around the armpit and down through the aperture at the side of the garment to a second or terminal end. The insulating sheath 54 is secured throughout its length, as by sewing with nonconductive thread, to the sleeve and body section of the garment.

Figure 6:
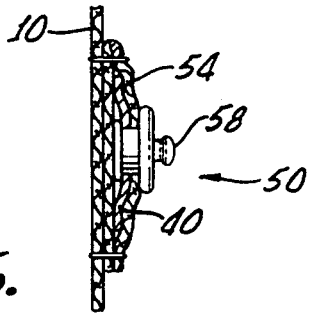
FIG. 6 illustrates the construction and insulation of the second grounding terminal.

At the terminal end of the conductor ribbon 40 and sheath 54, there is provided a second grounding terminal in the form of a pin 58 formed by the male portion of a conventional metal snap fastener. This grounding terminal 58 is secured to the sheath 54 and is electrically connected to and secured to the conductor 40. It is, however, insulated from the garment body section 10 by the sheath 54, as can be seen in FIG. 6.

Thus, there is a second redundant and completely independent grounding path from the second cuff 18, via the insulated conductor 40, to the second grounding terminal 58. The two grounding terminals 26 and 58 may be positioned at any portions of the garment. Preferably they are both located at a portion of the garment adjacent the hip of the wearer so that grounding wires connected thereto will provide the least impediment to motion of the wearer.

The two terminals 26,58 are juxtaposed so as to facilitate the use of a dual grounding connection cable that provides a single cable having two contacts for the two redundant grounding paths. One such dual grounding connection cable is shown in U.S. Pat. No. 4,639,825, which patent is hereby incorporated by reference herein.

It is emphasized that the cuff 18 is connected electrically between the skin of the wearer's wrist and the terminal 58 to form the second grounding path, but there is no connection of this grounding path to any other part of the garment. The cuff 16, on the other hand, is connected to the wearer's wrist and effectively to all other portions of the garment, including the grounding terminal 26, with the conductive garment thus providing both a Faraday cage shield and part of the first grounding path.

Both cuffs are stretchable tubular knit fabrics that tightly but comfortably encompass, press against and electrically contact the skin of the wearer's wrists.

The described garment has a number of advantages, as have been mentioned above. These advantages include the grounding of the wearer by two separate, independent and mutually isolated but redundant grounding paths. The garment provides a Faraday cage shield between the wearer's clothing and the workpiece. The garment also redirects the grounding path from the wrist to a point on the jacket that is not on the wearer's arm so that motion of the arm will not drag a grounding cable around to interfere with the work. Thus, both of the wearer's arms are free of any loosely hanging cables.

EMBODIMENT OF FIGS. 7 AND 8

Figure 7:
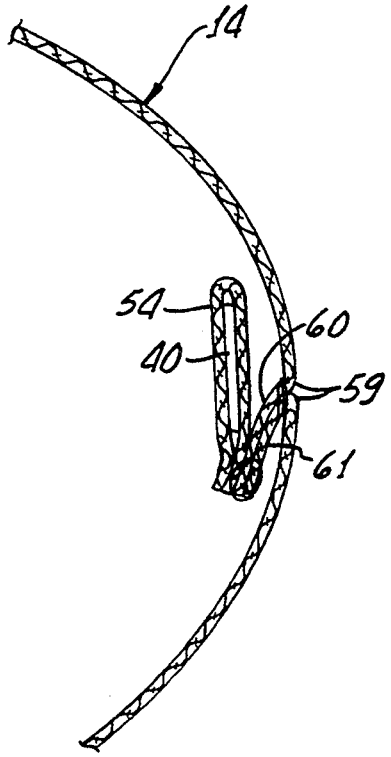
FIG. 7 is an enlarged section on line 7—7 of FIG. 1.

Referring to FIG. 7, there is shown the preferred manner of securing sheath 54 to the sleeve and to the garment body.

There is a bottom seam 59 on sleeve 14, and a corresponding side seam (not shown) at the side 46 of the garment body (FIG. 1). Each of such seams has two inwardly-extending edges 60,61, the inner parts of which are sewn so as to prevent raveling.

To both of such edges 60,61—on both the sleeve and side 46—is sewn the sheath 54 (with contained conductive ribbon 40) as shown in FIG. 7. This is done by nonconductive thread, and is very practical, economical, and effective, and the stitching is not visible from the exterior of the garment.

Figure 8:
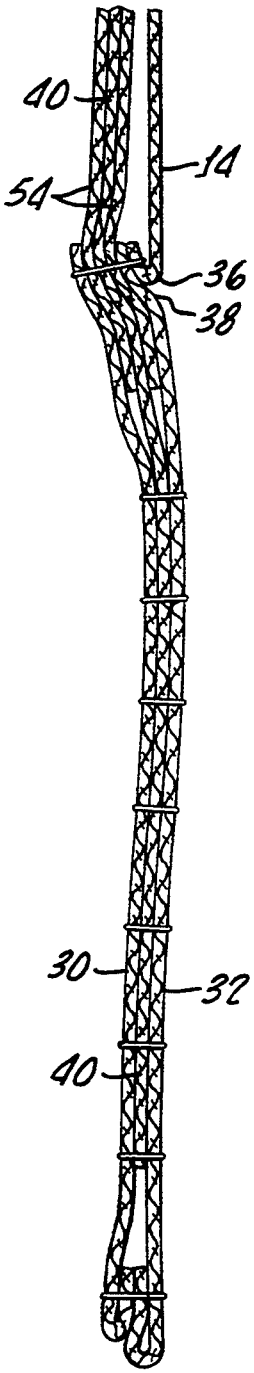
FIG. 8 is a section of the type shown in FIG. 5 but showing a second embodiment.

Referring next to FIG. 8, the construction is the same as that described relative to FIGS. 4 and 5, with the major exception that the conductive ribbon 40 and its sheath 54 are sandwiched between inner and outer cuffs 30 and 32, respectively. The ribbon 40 protrudes far out of the sheath, and all are sewn together by nonconductive thread. All other elements are identical to what is described above.

The foregoing detailed description is to be clearly understood as given by way of illustration and example only, the spirit and scope of this invention being limited solely by the appended claims.

What is claimed is:

1. A multi-path static control garment comprising:

an electrically conductive body section, first and second electrically conductive sleeve sections connected to said body section, first electrically conductive body contact means on said first sleeve section electrically connected to said body section and adapted to contact an arm of a wearer of the garment, second electrically conductive body contact means on said second sleeve section electrically insulated from said body section and adapted to contact an arm of the wearer of the garment, first and second mutually insulated grounding means mounted on said garment, said first grounding means being electrically connected to said garment and said second grounding means being electrically insulated from said garment, and connecting means insulated from said garment for electrically connecting said second electrically conductive body contact means to said second grounding means, whereby mutually isolated and independent conductive paths are provided between said body contact means on said first and second sleeves sections and said first and second grounding means, respectively.

2. The multi-path static control garment of claim 1 wherein said second electrically conductive body contact means comprises an inner cuff comprising electrically conductive material, and an outer cuff of electrically nonconductive material secured to said inner cuff and to said garment, said connecting means electrically interconnecting said inner cuff and said second grounding means.

3. The multi-path static control garment of claim 1 wherein said connecting means comprises an electrically conductive ribbon having a first end electrically connected to said second electrically conductive body contact means and extending from said second electrically conductive body contact means to said second grounding means, and an electrically nonconductive insulating sheath encompassing said electrically conductive ribbon to electrically insulate said electrically conductive ribbon from said second sleeve section and from said body section, said second grounding means comprising a grounding terminal electrically connected to said electrically conductive ribbon and physically secured to said insulating sheath, said second grounding terminal being electrically insulated from said garment body section.

4. A multi-path static control garment comprising:

a body section, first and second sleeve sections connected to said body section, first electrically conductive body contact means on said first sleeve section, second electrically conductive body contact means on said second sleeve section, first and second mutually insulated electrical grounding means mounted on said body section, first electrically conductive connecting means electrically interconnecting said first electrically conductive body contact means with said first grounding means, and second electrically conductive connecting means interconnecting said second electrically conductive body contact means with said second grounding means, said second electrically conductive connecting means being electrically insulated from said first electrically conductive connecting means, whereby two mutually independent and mutually isolated grounding paths are provided from said first and second sleeve sections, respectively.

5. The multi-path static control garment of claim 4 wherein said body section and at least said first sleeve section are formed of an electrically conductive garment material, said electrically conductive material forming said first electrically conductive connecting means, said second electrically conductive connecting means being insulated from said electrically conductive garment material.

6. The multi-path static control garment of claim 4 wherein said body section and at least said first sleeve section are formed of a garment material containing a grid of electrically conductive fibers forming a Faraday cage shield and also forming said first electrically conductive connecting means.

7. The multi-path static control garment of claim 4 wherein said second electrically conductive body contact means comprises a sleeve cuff assembly, said cuff assembly comprising a wrist hugging electrically conductive stretchable inner cuff, an electrically nonconductive outer cuff associated with said inner cuff and connected to said second sleeve section, an electrical conductor secured to said inner cuff and extending through said second sleeve and to said body section, and insulating means for electrically insulating said electrical conductor from said second sleeve and from said body section, said electrical conductor being electrically connected to said second grounding means.

8. The multi-path static control garment of claim 7 wherein said electrical conductor comprises an electrically conductive ribbon, said insulating means comprising an electrically nonconductive sheath enclosing said electrically conductive ribbon, said electrically conductive ribbon and said electrically nonconductive sheath having end portions secured to said garment body section, said second electrical grounding means comprising a ground terminal secured to said electrically conductive ribbon and to said electrically nonconductive sheath and insulated from said garment body section.

9. A multi-path static control garment comprising:

a body section, first and second sleeve sections, said body section and sleeve sections each formed of a garment material having an electrically conductive grid forming a Faraday cage shield, a first wrist hugging electrically conductive cuff on said first sleeve section connected electrically and physically to said first sleeve, a first grounding terminal electrically and physically connected to said body section, and thereby electrically connected to said first cuff, a second cuff assembly on said second sleeve section, said second cuff assembly comprising:

an electrically conductive wrist hugging inner cuff, an electrically nonconductive outer cuff secured to said inner cuff and secured to said second sleeve section, said outer cuff being interposed between said inner cuff and said second sleeve section to electrically insulate said second sleeve section from said inner cuff, an electrically conductive ribbon having one end thereof physically and electrically connected to said inner cuff and extending to a second end positioned adjacent to but spaced from said first grounding terminal, and insulating means interposed between said electrically conductive ribbon and said second sleeve section and interposed between said electrically conductive ribbon and said body section, and a second grounding terminal mounted to said insulating means and electrically connected to said second end of said electrically conductive ribbon.

10. The invention as claimed in claim 9, in which said ribbon has an end portion on the inner side of said inner cuff.

11. The invention as claimed in claim 9, in which said ribbon has an end portion sandwiched between said inner and outer cuffs.

* * * * *